United States Patent [19]

Inoue et al.

[11] Patent Number: 4,469,985

[45] Date of Patent: Sep. 4, 1984

[54] RADIATION-SENSITIVE TUBE USING PHOTOCONDUCTIVE LAYER COMPOSED OF AMORPHOUS SILICON

[75] Inventors: Eiichi Inoue, Tokyo; Isamu Shimizu, Kanagawa, both of Japan

[73] Assignee: Fuji Photo Film Co., Ltd., Kanagawa, Japan

[21] Appl. No.: 315,556

[22] Filed: Oct. 27, 1981

[30] Foreign Application Priority Data

Oct. 27, 1980 [JP] Japan ..... 55-149322

[51] Int. Cl.[3] ..... H01J 29/45; H01J 31/38

[52] U.S. Cl. ..... 313/366; 313/386

[58] Field of Search ..... 313/386, 366

[56] References Cited

U.S. PATENT DOCUMENTS

| | | | |
|---|---|---|---|
| 3,947,717 | 3/1976 | Busanovich et al. | 313/386 |
| 4,086,512 | 4/1978 | Dieleman et al. | 313/366 |
| 4,255,686 | 3/1981 | Maruyama et al. | 313/366 |

FOREIGN PATENT DOCUMENTS

| | | | |
|---|---|---|---|
| 0031663 | 7/1981 | European Pat. Off. | 313/386 |
| 0050036 | 5/1981 | Japan | 313/386 |

*Primary Examiner*—Palmer C. Demeo

*Attorney, Agent, or Firm*—Sughrue, Mion, Zinn, Macpeak and Seas

[57] ABSTRACT

A radiation-sensitive tube is described having a target comprising (1) an electrically conductive support, (2) at least one layer composed of insulative an amorphous silicon represented by the formula $Si_{1-x}N_x$ wherein $1>x$, y and $z\geqq 0$ and $1>x+y+z>0$ and (3) a photoconductive layer composed of amorphous silicon.

21 Claims, 4 Drawing Figures

RADIATION-SENSITIVE TUBE USING PHOTOCONDUCTIVE LAYER COMPOSED OF AMORPHOUS SILICON

FIELD OF THE INVENTION

This invention relates to a radiation sensitive tube using a photoconductive layer composed of amorphous silicon.

BACKGROUND OF THE INVENTION

Recently, a television camera tube using an amorphous thin film has been developed, but it has not yet succeeded in providing a sharp image. See The 12th Conference on Solid State Devices (Tokyo) 1980, Page 97 et seq. In U.S. patent application Ser. No. 259,221, filed on Apr. 30, 1981, a television camera tube is described using a target which is prepared by providing a blocking layer comprising an n-type amorphous silicon semiconductor and a photoconductive layer comprising amorphous silicon, usually having a conductivity (at 20° C.–25° C.) of less than $10^{-8}$ $(\Omega\ cm)^{-1}$, coated on an electrically-conductive layer in the sequence listed. This application also discloses that the formation of a cover layer having an electron-retention action on the light-sensitive layer further increases the sharpness of images formed therewith.

However, when vidicon type camera operations are performed using a camera tube having a target of the blocking layer-photoconductive layer construction as described above which is prepared using amorphous silicon (hereinafter referred to simply as "a-Si") as a homojunction, visible light having wavelengths of 550 nm or less is absorbed by the blocking layer and the light-electricity conversion efficiency is limited. It has therefore been desired to make further improvements in order to obtain sharp images.

SUMMARY OF THE INVENTION

An object of the invention is to provide a radiation-sensitive tube which provides sharp images.

Another object of the invention is to provide a radiation-sensitive tube having good heat resistance and long service life.

Still another object of the invention is to provide a radiation-sensitive tube which is preferably used as a television camera tube.

It has been found that the objects can be attained by using a layer made of a specific amorphous silicon-containing substance as a blocking layer and/or cover layer for a target of a radiation sensitive tube.

This invention, therefore, comprises a radiation sensitive tube having a target comprising (1) an electrically conductive support, (2) at least one layer composed of an amorphous silicon-containing substance represented by the formula $Si_{1-x-y-z}N_xC_yO_z$, wherein $1>x$, y and $z\geqq 0$ and $1>x+y+z>0$, and (3) a photoconductive layer composed of amorphous silicon. The layer composed of an amorphous silicon-containing substance is adjacent to the photoconductive layer.

DETAILED DESCRIPTION OF THE INVENTION

Figure 1:
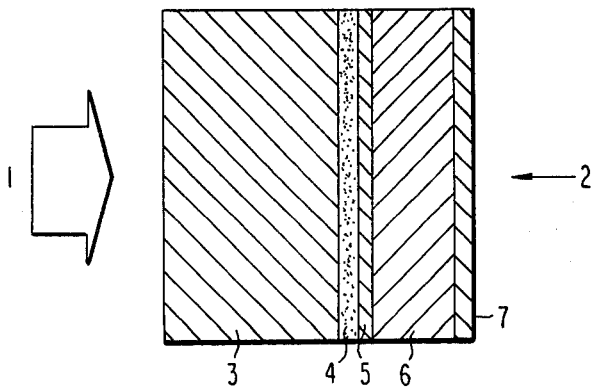
FIG. 1 is a schematic cross-sectional view of a camera tube using a target according to the invention.

In general, any electrically-conductive support used in conventional vidicons can be used in this invention. For example electrically-conductive supports prepared by providing a layer of an electrically-conductive substance, such as $SnO_2$, $In_2O_3$, and CdO, $(SnO_2)_x(In_2O_3)_{1-x}(0<x\leqq 1)$, which are used as transparent or translucent electrodes, on a transparent insulative material made of, for example, glass or plastics, which is used as a face plate of a target, can be used.

The thickness of the layer of the electrically-conductive substance is generally from about 0.005μ to about 10μ, and preferably from about 0.01μ to about 0.2μ. This layer can be formed by providing $SnO_2$, $In_2O_3$, etc., on the face plate by sputtering, vacuum deposition, and so forth. Layer of compounds such as $SnO_2$, etc., can be provided by methods such as spraying.

The blocking layer is provided between an electrically-conductive support and a photoconductive layer. When the blocking layer is made of substances having a band gap greater than 1.6 eV of the a-Si photoconductive layer, it is possible to form charge carriers sufficiently in the photoelectric layer. That is, utilization of a window effect at the hetero junction permits improvement in the light-electricity conversion efficiency and the obtainment of sharp images.

As a result of extensive investigations to find materials meeting the above described requirements, it has been found that the use of amorphous materials represented by the above described formula: $Si_{1-x-y-z}N_xC_yO_z$ permit formation of the desired blocking layer. That is, a radiation sensitive tube having a very high light-electricity conversion efficiency can be produced by using a blocking layer comprising an amorphous thin film represented by the formula $Si_{1-x-y-z}N_xC_yO_z$.

Amorphous silicon-containing substances represented by the formula $Si_{1-x-y-z}N_xC_yO_z$ (hereinafter also more simply represented by a-$Si_{1-x-y-z}N_xC_yO_z$) include $Si_{1-x}N_x$, $Si_{1-y}C_y$, $Si_{1-z}O_z$, $Si_{1-x-y}N_xC_y$, $Si_{1-x-z}N_xO_z$, $Si_{1-y-z}C_yO_z$, $Si_{1-x-y-z}N_xC_yO_z$ (in these formulas x, y and $z>0$). The ratio of atoms of Si, N, C and O in the a-substance can be determined such that the electroconductivity and the transmission of visible light of the amorphous silicon satisfy particular properties described below.

The transmission (at 500 nm) of the blocking layer preferably should be more than 50%, and more preferably more than 70%, measured of using a blocking layer of 100 Å thickness. The transmission of the amorphous substance represented by the above-described formula which contains N and/or O increases as the content of N and/or O increases, and the amorphous substance containing C is particularly excellent when y in $Si_{1-y}C_y$ is from about 0.6 to 0.8.

The conductivity ($\delta_{RT}$) of the blocking layer of the present invention (at 20° C. to 25° C.) is approximately $10^{-13}$ $(\Omega\ cm)^{-1}$ or less, preferably about $10^{-14}$ $(\Omega\ cm)^{-1}$ or less. When the conductivity is more than $10^{-13}$ $(\Omega\ cm)^{-1}$, the electric charge injection-preventing effect is insufficient.

The thickness of the blocking layer is preferably as small as possible. However, the blocking layer will generally have a thickness of 50 Å or more, preferably from about 100 Å to about 0.1μ. When the thickness is less than 50 Å, the electric charge injection-preventing effect is not sufficient. On the other hand, when it is more than 1μ, the proportion of light reaching the amorphous silicon of the light-sensitive layer is greatly reduced.

In order to obtain a high photoconductive gain over the whole visible region, a blocking layer having a thickness of less than about 0.1μ is used. In order to obtain a high photo-current using a low target voltage, it is also preferred to use a blocking layer having a thickness of less than about 0.1μ.

The amorphous silicon-containing substance used as the blocking layer may contain hydrogen in an amount up to 40 atomic %. Additionally, amorphous silicon containing up to about 5 atomic % of hydrogen and about 0.01 to 20 atomic % of F, Cl or I can be used. The blocking layer may further contain minor amounts of impurities such as N, P, As, Sb, Bi, B, Al, Ga, In and Tl.

The blocking layer can be provided on the electrode layer of the electrically-conductive layer by known methods, such as glow discharge decomposition, sputtering, and ion-plating. Of these methods it is preferred to use glow discharge decomposition, because production of a blocking layer and the a-Si photoconductive layer can be conducted continuously using a glow discharge decomposition method.

Hereinafter, a method of producing the blocking layer will be explained by reference to glow discharge decomposition.

In accordance with this method, a gas mixture of a compound containing silicon and at least one compound containing nitrogen, carbon and/or oxygen is decomposed by glow discharge and an amorphous silicon is deposited on a substrate. Examples of useful silicon compounds include compounds represented by the formula $SiH_nX_{4-n}$ (wherein X is F, Cl or I, and n is an integer of 0 to 4), such as $SiH_4$, $SiF_4$, $SiHF_3$, $SiH_3Cl$, $SiH_2Cl_2$, $Si_2H_6$, or a mixture thereof. Of these silicon compounds $SiH_4$, $Si_2H_6$ and $SiF_4$ are preferable because they provide a layer having excellent electric characteristics. The silicon compounds are usually used in the form of gas. They may be used in pure form or diluted with an inert gas, such as Ar, He, Xe, etc. or $H_2$; usually to a concentration of about 5 to 50 mol%.

Compounds which are used for sources are those which produce atoms, radicals or ions of N, C and/or O upon glow discharge decomposition. Examples for such compounds include $N_2$ and $NH_3$ (for supplying N) $N_2O$ and NO (for supplying N and O), saturated and unsaturated aliphatic hydrocarbon and chloride thereof, such as $CH_4$, $C_2H_6$, $C_2H_2$, $CCl_4$, $CH_2Cl_2$, $CHCl_3$ and $CH_3Cl$ (for supplying C or C and Cl, $O_2$ and $H_2O$ (for supplying O).

The desired concentration of the compound in the gas mixture can be easily determined based on the atomic ratio of N, C and/or O desired in the material represented by the formula $Si_{1-x-y-z}N_xC_yO_z$. The preferred atomic ratio of N, C and/or O in the amorphous silicon compound can be determined experimentally depending on the particular properties desired. A preferred range of each x, y and z in $Si_{1-x}N_x$, $Si_{1-y}C_y$ and $Si_{1-z}O_z$ is about 0.4 to 0.9, and the more preferred range is 0.5 to 0.8. Usually, values of x+y, x+z, y+z and x+y+z are about 0.1 to 0.9. The concentration can also be varied depending on conditions for producing the blocking layer and the kind of compounds which are used as sources for N, C and/or O. Examples for a molar ratio of $SiH_4$ and $N_2$ in the gas mixture thereof is generally from about 1/35 to 1/500, and preferably from about 1/50 to 1/100. The gas pressure of a vessel in which glow discharge is performed in generally from about $10^{-2}$ to 10 Torr. The current between the electrode and the substrate may be a DC current, an AC current, or superposed currents. When the AC current is used, a useful frequency is from about 1 Hz to about 4,000 MHz.

Useful doping agents for doping N,P, As, Sb and Bi include compounds containing impurity atoms, such as $NH_3$, $PH_3$, $AsH_3$, $SbCl_3$ and $BiCl_3$. $PH_3$ is preferred from a standpoint of handling because it is in gaseous form at ordinary temperature. The amount of the doping agent fed to the glow discharge apparatus is about 0 to 20,000 ppm (by volume; hereinafter, all ppms are by volume), preferably about 100 to 3,000 ppm, based on the volume of the silicon compound. However, the amount of doping agent fed varied depending on the substrate temperature.

Doping agents for doping B, Al, Ga, In and Tl include, for example, $B_2H_6$, $BCl_3$, $BBr_3$, $BF_3$, $AlCl_3$, $GaCl_3$ and $InCl_3$. Of these compounds, boron compounds are preferred from a standpoint of operation because they typically exist in gaseous form at ordinary temperature. The amount of these compounds is fed to the glow discharge apparatus is generally from about 0.1 to about 100 ppm, and preferably from about 2 to about 50 ppm, based on the weight of the silicon compound, although it varies depending on the substrate temperature. The weight ratio of impurity atoms to the silicon atoms in the thus-obtained photoconductive layer is approximately the same as that in the glow discharge apparatus.

The substrate temperature is generally from about 200° C. to about 350° C.

The photoconductive layer is preferably made of an i-type semiconductor wherein the Fermi level is present in nearly the center of band whose conductivity (at 20°-25° C.) is as small as is practically possible, i.e., usually, about $10^{-8}$ $(\Omega\ cm)^{-1}$ or less and preferably $10^{-9}$ $(\Omega\ cm)^{-1}$ or less. In such semiconductors, there are a small number of defects in the atomic structure, and the average localized density is about $10^{17}/cm^3$ or less. When a photoconductive layer having a conductivity of about $10^{-8}$ to $10^{-13}$ $(\Omega\ cm)^{-1}$ is used, the effect of this invention is prominently exhibited. Even if the photoconductive layer used has a conductivity of less than $10^{-13}$ $(\Omega\ cm)^{-1}$, a blocking layer according to the present invention can be used therewith.

The thickness of the photoconductive layer is generally from about 0.5μ to about 10μ and preferably from about 1.5μ to about 5μ.

The amorphous semiconductive layer used as the photoconductive layer is preferably composed of an amorphous silicon containing about 0.1 to 40 atomic % hydrogen. Additionally, amorphous silicon containing about 0.1 to 5 atomic % hydrogen and about 0.01 to 20 atomic % halogen such as F, Cl, or I can be present. The photoconductive layer contains no impurities, or contains only small amounts of impurity such as B, Al, Ga, In and Tl.

By providing a blocking layer according to the present invention in the camera tube using the photoconductive layer composed of the amorphous silicon semiconductor, a sharp image can be obtained. The sharpness of the image can be further increased by providing a cover layer on the photoconductive layer. The cover layer increases the electron retention ability of the camera tube upon the scanning of electron beams.

The cover layer is made of a substance having a high specific resistance, usually at least $10^{12}$ Ω cm, having an electron mobility, usually less than $10^{-4}$ $cm^2$/volt.sec. Examples of such substances which can be used include amorphous chalcogen, such as Se; amorphous chalcogenide, such as As-Se-S, Ge-S, Ge-Se, Sb-S, As-S, As-Se, and As-S based ones, e.g., $Sb_2S_3$, $As_2Se_3$, and $As_2Se_{1.5}Te_{1.5}$, and amorphous substances, such as $SiO_2$, SiO, $Al_2O_3$, $ZrO_2$, $TiO_2$, $MgF_2$, ZnS, and the above-described substances represented by the formula $Si_{1-x-y-z}N_xC_yO_z$. Of these substances, amorphous chalcogenides are preferred for retaining electrons at the surface thereof. Furthermore, they are preferred because of smoothness of transfer of photo-holes generated from the interior of the light sensitive layer upon exposure to light. Furthermore, of these substances the above-described amorphous substances represented by $Si_{1-x-y-z}N_xC_yO_z$ are preferred because of their heat resistance property.

The thickness of the cover layer is usually from about 0.005μ to about 50μ, and preferably from about 0.05μ to about 1μ. The cover layer can be provided on the light-sensitive layer by glow discharge, vacuum deposition, sputtering or like methods.

According to the invention, a target can be used which is produced by providing a cover layer composed of an amorphous substance represented by the formula: $Si_{1-x-y-z}N_xC_yO_z$ on a photoconductive layer which is provided directly on an electrically conductive support, or after provision of a blocking layer composed of a known substance on the electrically conductive support, is provided on the blocking layer. This cover layer can be prepared in the same manner as described for the above blocking layer.

For determining the characteristics of an amorphous $Si_{1-x}N_x$ layer, the following experiment was conducted.

A $Si_{1-x}N_x$ thin film of thickness of 0.5μ was prepared in the same manner as described for the preparation of Sample No. 5 in Example 1 hereinafter, except that the proportion of $SiH_4$ in the mixed gas was changed as shown in Table 1.

For the thus prepared a-$Si_{1-x}N_x$ thin film, the optical gap ($Eg^{opt}$), the conductivity at 60° C. in a dark place ($\sigma_{60}$), and the value of x were measured, and the results are shown in Table 1.

TABLE 1

| Run No. | 1 | 2 | 3 | 4 |
|---|---|---|---|---|
| $SiH_4/(SiH_4 + N_2)$ (molar ratio) | 1/12 | 1/30 | 1/60 | 1/100 |
| $Eg^{opt}$ (ev) | 1.8 | 2.0 | 2.5 | more than 3 |
| $\sigma_{60}$ $(\Omega\ cm)^{-1}$ | $3 \times 10^{-9}$ | $2 \times 10^{-11}$ | about $10^{-14}$ | less than $10^{-14}$ |
| x (error of measurement: ±10% | 0.25 | 0.35 | 0.50 | 0.60 |

As the blocking layer, it is preferred from the viewpoint of conductivity that x be about 0.5 or more. When x is about 0.6 or more, the transparency is excellent.

The target as used herein can be prepared very conveniently since combinations of (1) blocking and photoconductive layers, (2) blocing, photoconductive, and cover layers, or (3) photoconductive and cover layers can be prepared continuously by glow discharge decomposition in the same chamber.

The radiation sensitive tube of the present invention is preferably used as a television camera tube.

The following examples are provided to illustrate this invention in greater detail.

EXAMPLE 1

$In_2O_3$-$SnO_2$ ($SnO_2$: 5 mol%) was vapor-deposited on a glass face plate having a diameter of 2.5 cm in a thickness of 0.1μ by means of electron beam and was subjected to heat-treatment in air at 300° C. for 30 minutes to form a transparent electrode having a conductivity of 100 Ω/□ and a transmission of visible light (500 nm) of 80%. A mixture of $SiH_4$ and $N_2$ gases (molar ratio of $SiH_4/(SiH_4+N_2)$: 1/100) was decomposed by glow discharge to form a blocking layer on the $In_2O_3$-$SnO_2$ layer as prepared above. The blocking layer was prepared at the gas mixing ratio (mole) shown in Table 1 and under the conditions of a pressure in the discharge decomposition apparatus of 0.2 Torr, a gas flow rate of 60 ml/min, a substrate temperature of 250° C., a deposition rate of 1 to 2 Å/sec, and a high frequency (13.56 MHz) power of 30 W. The thickness of the blocking layer for various samples is shown in Table 2.

On the thus prepared blocking layer, a 1.2 μm thick a-Si photoconductive layer was provided by the decomposition of a mixed gas of $SiH_4$ and $B_2H_6$ ($B_2H_6$ content: 10 ppm) by glow discharge.

On the photoconductive layer of each of Sample Nos. 1 to 4 was provided a 0.2μ cover layer by vacuum deposition of $As_2Se_{1.5}Te_{1.5}$. In the case of Sample No. 5, a 300 Å cover layer was provided in the same manner as for the blocking layer. Sample 6 did not have a cover layer.

TABLE 2

| | Target for Camera Tube | | |
|---|---|---|---|
| Sample No. | Blocking Layer (Å) | Photoconductive Layer (μm) | Cover Layer (μm) |
| 1 | a-$Si_{1-x}N_x$ (50) | a-Si(B-10) (1.2) | $As_2Se_{1.5}Te_{1.5}$(0.2) |
| 2 | a-$Si_{1-x}N_x$ (100) | " | " |
| 3 | a-$Si_{1-x}N_x$ (300) | " | " |
| 4 | a-$Si_{1-x}N_x$ (1000) | " | " |
| 5 | a-$Si_{1-x}N_x$ (100) | " | a-$Si_{1-x}N_x$ (300 Å) |
| 6 | a-$Si_{1-x}N_x$ (100) | " | none |

In Table 2, x is 0.55 (The measurement error is 10%)

FIG. 1 is a cross-sectional view of the above prepared target in the state in which it was used as a target for a camera tube. Referring to FIG. 1, the reference numerals 1, 2, 3, 4, 5, 6 and 7 indicate, respectively, incident light (1), an electron beam (2), a face plate (3), the transparent electrode (4), the blocking layer (5), the photoconductive layer (6), and the cover layer (7).

Figure 2:
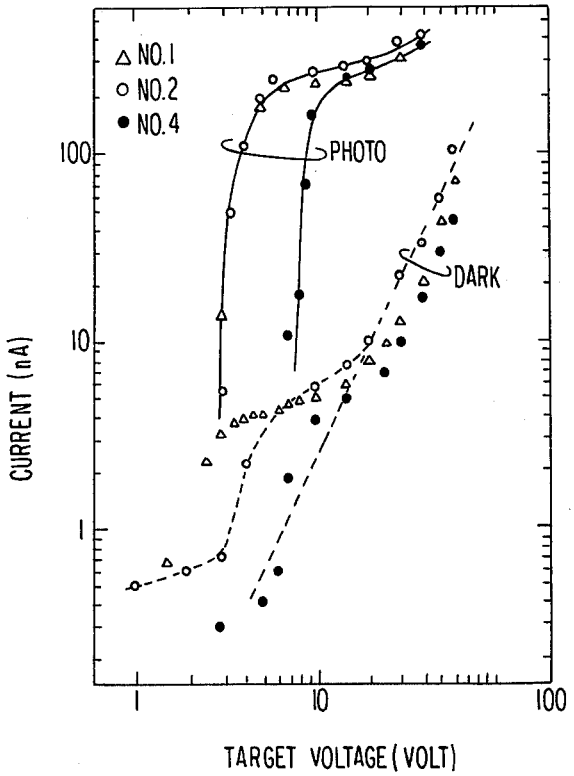
FIG. 2 is a graph showing the current vs. target voltage relation of a target of the invention.

FIG. 2 shows the dark current and photo signal current characteristics at a predetermined illumination of 4 lux.$cm^{-2}$ when the photoconductive thin film of each of Sample Nos. 1, 2 and 4 was used as a target for a television camera tube.

In the dark current vs. target voltage characteristic curve shown in FIG. 2, a steep increase in the current and its saturation are observed at a low target voltage range. This phenomenon is caused by the radiation from the electron gun used and is not due to the inherent characteristics of each thin film.

It can be seen from FIG. 2 that when the camera tube according to the invention is used, a photo-current signal which is independent of the target voltage and is nearly in proportion to the intensity of incident light can be obtained.

Figure 3:
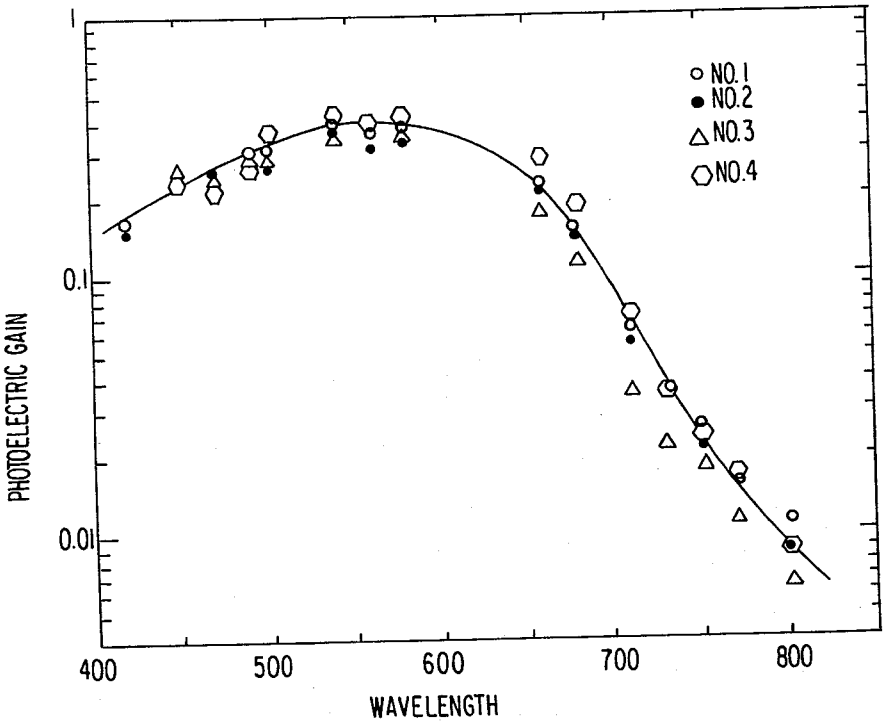
FIG. 3 is a graph showing the relation between wavelength and photoconducting gain of a target of the invention.

FIG. 3 shows the spectral sensitivity characteristics of Sample Nos. 2, 3 and 4 of the above prepared target. As can be readily seen from Table 3, when an a-$Si_{1-x}N_x$ layer is used as a blocking layer, no great difference is observed in light-sensitivity characteristics among target Sample Nos. 1 to 4, although they have different film thicknesses (from 50 Å to 1,000 Å). This is due to the fact that the light transmission of the blocking layer is high over the entire visible light region, and the photo-signal loss in the blocking layer is very small. Also, the reduction in sensitivity is small in the blue light (short wavelength light) region. Furthermore, since FIG. 3 does not take into account the reflection of the a-Si photoconductive layer (36% at 600 nm), the actual gain of the camera tube is higher than that shown in FIG. 3.

Figure 4:
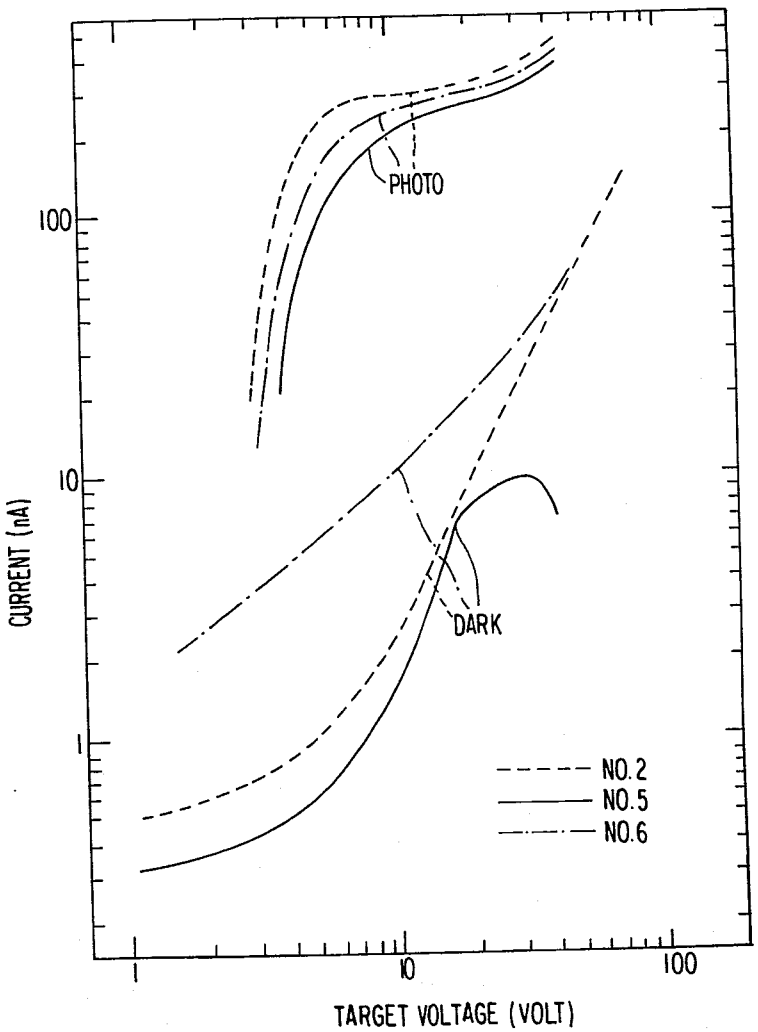
FIG. 4 is a graph showing the current vs. target voltage relation of a target of the invention.

For Sample Nos. 5 and 6 shown in Table 1, the dark current and photo signal current vs. target voltage characteristics were determined, and the results are shown in FIG. 4. The cover layer for the target of Sample No. 5 is preferred from a standpoint of operation since it can be prepared in the same glow discharge tube as used for the preparation of the photoconductive layer and the blocking layer.

EXAMPLE 2

Using a mixed gas (diluted with Ar gas to a concentration of 2 vol%) of $SiH_4$ and $O_2$ (mixing ratios of $SiH_4$ and $O_2$ are shown in Table 3), glow discharge was performed under the conditions of a substrate temperature of 300° C., an inner pressure in the reaction tube of 0.2 Torr, a gas flow rate of 60 ml/min, a deposition rate of 1-2 A/sec, a RF (13.56 MHz) power of 30 W to prepare a 0.02μ film composed of $Si_{1-z}O_z$. The characteristic values and the value of z were measured and the results are shown in Table 3.

TABLE 3

| Run No. | 1 | 2 | 3 | 4 |
|---|---|---|---|---|
| $SiH_4/(SiH_4 + O_2)$ (molar ratio) | 99.9/100 | 99/100 | 95/100 | 90/100 |
| $EG^{opt}$ (eV) | 1.7 | 1.9 | 2.5 | more than 3 |
| $\sigma_{60}$ $(\Omega\ cm)^{-1}$ | $10^{-12}$ | $10^{-13}$ | $10^{-14}$ | less than $10^{-14}$ |
| z (error of measurement: ±10%) | 0.001 | 0.05 | 0.35 | 0.55 |

In the same manner as in Example 1 except that instead of the blocking layer composed of $Si_{1-x}N_x$, blocking layers composed of $Si_{1-z}O_z$ of Run Nos. 2, 3 and 4 were provided, three targets were prepared.

EXAMPLE 3

Using a mixed gas of $SiH_4$ and $CH_4$ (mixing ratio: shown in Table 4), glow discharge was performed under the conditions of a substrate temperature of 200° C., an inner pressure in the reaction tube of 0.2 Torr, a gas flow rate of 60 ml/min, a deposition rate of 2 A/sec, and a RF (13.56 MHz) power of 30 W to prepare a 0.5μ film composed of $Si_{1-y}C_y$. The characteristic values and the value of y were measured by the same methods as described in Example 2, and the results are shown in Table 4.

TABLE 4

| Run No. | 1 | 2 | 3 | 4 |
|---|---|---|---|---|
| $SiH_4/(SiH_4 + CH_4)$ (molar ratio) | 0.8 | 0.6 | 0.4 | 0.3 |
| $EG^{opt}$ (eV) | 1.8 | 2.2 | 2.5 | 2.8 |
| $\sigma_{60}$ $(\Omega\ cm)^{-1}$ | $10^{-11}$ | $10^{-13}$ | $10^{-14}$ | $<10^{-14}$ |
| y (error of measurement: ±10%) | 0.8 | 0.6 | 0.4 | 0.3 |

In the same manner as in Example 1 three targets were prepared, except that blocking layers composed of $Si_{1-y}C_y$ of Run Nos. 2, 3 and 4, respectively, were applied instead of the blocking layer composed of $Si_{1-x}N_x$.

EXAMPLE 4

In the same manner as in Example 1 a target was prepared, except that a blocking layer composed of $Si_{1-x-z}N_xO_z$ was produced using a gas mixture of $SiH_4$ and $NO_2$ of a molar ratio of 1:1, a substrate temperature was 300° C. and thickness of the blocking layer was 300 Å.

EXAMPLE 5

In the same manner as in Example 1 a target was prepared, except that a blocking layer composed of $Si_{1-y-z}C_yO_z$ was produced using a gas mixture of $SiH_4$ and $CO_2$ of a molar ratio of 1:1, a substrate temperature was 300° C. and thickness of the blocking layer was 300 Å.

With a camera tube prepared using the targets obtained in Examples 1-5, the monitor image, printing, residual image, and so forth were determined, and good results supporting the above characteristics were obtained.

Although the foregoing examples have illustrated cases wherein the thin film represented by definite formulas are produced and wherein the thin film are grown by glow discharge decomposition, targets for camera tubes can be prepared by using substances of a-$Si_{1-x-y-z}N_xC_yO_z$ in various combinations of N, C and O and atomic ratios thereof can also be used as a blocking layer and/or a cover layer by the same glow discharge decomposition technique or other technique with similar results.

While the invention has been described in detail and with reference to specific embodiments thereof, it will be apparent to one skilled in the art that various changes and modifications can be made therein without departing from the spirit and scope thereof.

What is claimed is:

1. A radiation-sensitive tube having a target comprising (1) an electrically conductive support, (2) at least one layer composed of an amorphous silicon-containing substance represented by the formula $Si_{1-x-y-z}N_xC_yO_z$ wherein $1>x, y, z\geqq 0$ and $1>x+y+z>0$, and (3) a photoconductive layer composed of amorphous silicon, said layer composed of an amorphous silicon-containing substance is adjacent to the photoconductive layer, said at least one layer (2) being positioned as a blocking layer (A) between said support (1) and the said photoconductive layer (3) and/or being positioned as a cover layer (B) on the surface of layer (3) opposite from support (1).

2. A radiation-sensitive tube as in claim 1, wherein $Si_{1-x-y-z}N_xC_yO_z$ is $Si_{1-x}N_x$.

3. A radiation-sensitive tube as in claim 1, wherein $Si_{1-x-y-z}N_xC_yO_z$ is $Si_{1-y}C_y$.

4. A radiation sensitive tube as in claim 1, wherein $Si_{1-x-y-z}N_xC_yO_z$ is $Si_{1-z}O_z$.

5. A radiation-sensitive tube as in claim 1, wherein the target comprises a blocking layer composed of amorphous silicon-containing substance represented by the formula $Si_{1-x-y-z}N_xC_yO_z$.

6. A radiation-sensitive tube as in claim 1, wherein the target comprises a cover layer composed of amorphous silicon-containing substance represented by the formula $Si_{1-x-y-z}N_xC_yO_z$.

7. A radiation-sensitive tube as in claim 1, wherein the target comprises a blocking layer and a cover layer, each being composed of the amorphous silicon-containing substance represented by the formula $Si_{1-x-y-z}N_xC_yO_z$.

8. A radiation-sensitive tube as claimed in claim 5 or 7 wherein the transmission (at 500 nm) of the blocking layer is more than 50% for a blocking layer of 100 Å thickness.

9. A radiation-sensitive tube as in claim 5 or 7, wherein the blocking layer has a conductivity of $10^{-13}$ $(\Omega\ cm)^{-1}$ or less.

10. A radiation-sensitive tube as in claim 6 or 7, wherein the cover layer has a specific resistance of $10^{12}$ $\Omega$ cm or more.

11. A radiation-sensitive tube as in claim 1, wherein the photoconductive layer has a conductivity of $10^{-8}$ $(\Omega\ cm)^{-1}$ or less.

12. A radiation-sensitive tube as in claim 9, wherein the blocking layer has a film thickness of 0.005 to 1$\mu$.

13. A radiation-sensitive tube as in claim 12, wherein the blocking layer has a film thickness of 0.1$\mu$ or less.

14. A radiation-sensitive tube as in claim 10, wherein the cover layer has a film thickness of 0.005 to 50$\mu$.

15. A radiation-sensitive tube as in claim 11, wherein the photoconductive layer has a film thickness of 0.5 to 10$\mu$.

16. A radiation-sensitive tube as in claim 1, wherein the value of x, y or z, respectively, is from 0.4 to 0.9.

17. A radiation-sensitive tube as in claim 1, wherein the value of x, y or z, respectively, is from 0.5 to 0.8.

18. A radiation-sensitive tube as in claim 1, wherein the value of $x+y+z$, $x+y$, $x+z$ or $y+z$, respectively, is from 0.1 to 0.9.

19. A radiation-sensitive tube as in claim 5, wherein a cover layer composes of an amorphous chalcogenide.

20. A radiation-sensitive tube as in claim 1, wherein $Si_{1-x-y-z}N_xC_yO_z$ is $Si_{1-x-z}N_xO_z$.

21. A radiation-sensitive tube as in claim 1, wherein $Si_{1-x-y-z}N_xC_yO_z$ is $Si_{1-y-z}C_yO_z$.

* * * * *